US009672711B2

(12) United States Patent
Niederhuefner

(10) Patent No.: US 9,672,711 B2
(45) Date of Patent: Jun. 6, 2017

(54) SYSTEM AND METHOD FOR INTEGRATED PRODUCT PROTECTION

(75) Inventor: Joerg Niederhuefner, Altenmedingen (DE)

(73) Assignee: Southern Imperial, Inc., Rockford, IL (US)

( * ) Notice: Subject to any disclaimer, the term of this patent is extended or adjusted under 35 U.S.C. 154(b) by 1398 days.

(21) Appl. No.: 13/345,284

(22) Filed: Jan. 6, 2012

(65) Prior Publication Data

US 2012/0176244 A1 Jul. 12, 2012

Related U.S. Application Data

(60) Provisional application No. 61/430,579, filed on Jan. 7, 2011, provisional application No. 61/453,423, filed on Mar. 16, 2011.

(51) Int. Cl.

| | |
|---|---|
| ***G08B 13/14*** | (2006.01) |
| ***G08B 15/02*** | (2006.01) |
| *G08B 21/02* | (2006.01) |

(52) U.S. Cl.

CPC ..... *G08B 15/02* (2013.01); *G08B 13/1427* (2013.01); *G08B 21/0213* (2013.01); *G08B 21/0275* (2013.01)

(58) Field of Classification Search

CPC ..... G06K 7/10366; G06K 7/0008; G06K 7/10009; G06K 19/0723; G06K 7/01; G06K 19/07749; G06K 2017/0041; G06K 19/07716; H01Q 1/2225; H01Q 7/00; H01Q 1/22; H01Q 1/38

USPC ..... 340/10.1–10.6, 568.1, 568.2, 571, 340/572.1–572.9; 53/507, 508; 221/3

See application file for complete search history.

(56) References Cited

U.S. PATENT DOCUMENTS

| | | | |
|---|---|---|---|
| 5,574,431 | A | 11/1996 | McKeown et al. |
| 5,640,002 | A | 6/1997 | Ruppert et al. |
| 5,871,100 | A | 2/1999 | Ward |

(Continued)

FOREIGN PATENT DOCUMENTS

| | | |
|---|---|---|
| DE | 38 07 936 A1 | 9/1989 |
| EP | 2 051 219 A1 | 4/2009 |

(Continued)

OTHER PUBLICATIONS

James Dudlicek; Bending Into Shape; Dairy Foods; Aug. 1, 2008; 3 pages; vol. 109, No. 8, p. 102.

(Continued)

*Primary Examiner* — Kerri McNally
*Assistant Examiner* — Sharmin Akhter
(74) *Attorney, Agent, or Firm* — Reinhart Boerner Van Deuren P.C.

(57) ABSTRACT

A method of preventing the theft of packaged products from a building, in which the method includes the steps of incorporating an electronic device into the packaging material for the packaged product, and configuring the electronic device to activate an alarm if the packaged product is removed from the building prior to deactivation of the electronic device. In a particular embodiment, the method further includes configuring the electronic device to impair the function or appearance of the packaged product if the packaged product is removed from the building prior to deactivation of the electronic device.

30 Claims, 2 Drawing Sheets

(56) References Cited

U.S. PATENT DOCUMENTS

| | | | | |
|---|---|---|---|---|
| 5,910,770 | A * | 6/1999 | Ohara | 340/572.5 |
| 6,005,476 | A | 12/1999 | Valiulis | |
| 6,317,028 | B1 | 11/2001 | Valiulis | |
| 6,395,373 | B2 | 5/2002 | Conti et al. | |
| 6,478,229 | B1 | 11/2002 | Epstein | |
| 6,539,280 | B1 | 3/2003 | Valiulis et al. | |
| 6,780,265 | B2 | 8/2004 | Bleckmann et al. | |
| 6,853,303 | B2 | 2/2005 | Chen et al. | |
| 7,159,298 | B2 | 1/2007 | Lieberman | |
| 7,219,362 | B2 | 5/2007 | Beckwith et al. | |
| 7,318,524 | B2 | 1/2008 | Compton et al. | |
| 7,388,485 | B1 * | 6/2008 | Shen | 340/541 |
| 7,528,727 | B2 | 5/2009 | Morrow | |
| 7,685,706 | B2 | 3/2010 | Maruyama et al. | |
| 7,700,463 | B2 | 4/2010 | Shimomura | |
| 7,920,063 | B2 | 4/2011 | Ulrich | |
| 7,990,273 | B2 | 8/2011 | Handyside et al. | |
| 8,004,406 | B2 | 8/2011 | Bleckmann et al. | |
| 2002/0130777 | A1 * | 9/2002 | Besnard | 340/568.7 |
| 2003/0188470 | A1 | 10/2003 | Valiulis | |
| 2004/0036577 | A1 * | 2/2004 | Simoneau | 340/10.51 |
| 2005/0149387 | A1 | 7/2005 | O'Shea et al. | |
| 2008/0186367 | A1 | 8/2008 | Adkins et al. | |
| 2008/0191001 | A1 | 8/2008 | Chandaria | |
| 2010/0000441 | A1 * | 1/2010 | Jang et al. | 106/31.13 |
| 2010/0060455 | A1 | 3/2010 | Frabasile | |
| 2010/0134257 | A1 | 6/2010 | Puleston et al. | |
| 2010/0315238 | A1 | 12/2010 | Yang | |
| 2011/0072132 | A1 * | 3/2011 | Shafer et al. | 709/224 |

FOREIGN PATENT DOCUMENTS

| | | | |
|---|---|---|---|
| GB | 2 305 074 | A | 3/1997 |
| GB | 2 462 725 | A | 2/2010 |
| WO | WO 00/05820 | A1 | 2/2000 |
| WO | WO 01/76423 | A2 | 10/2001 |
| WO | WO 01/99074 | A2 | 12/2001 |
| WO | WO 2007/070938 | A1 | 6/2007 |

OTHER PUBLICATIONS

Dri-Loc® Theft-Sensor Pad; known prior to Jan. 6, 2012; 1 page printed from internet http://www.cryovac.com/na/en/food-packaging-products/driloc-theft-sensor-aspx.

Karen Collier; Electronic Steak-Outs; Daily Telegraph (Sydney, Australia); Oct. 1, 2011; 2 pages; 1—State ed, p. 23.

Electronic Article Surveillance; known prior to Jan. 6, 2012; 3 pages printed from internet http://www.adt.com/commercial-security/products/electronic-article-surveillance.

Compiled by the Class for Physics of the Royal Swedish Academy of Sciences; Scientific Background on the Nobel Prize in Physics 2010—Graphene; Oct. 5, 2010; 13 pages; The Royal Swedish Academy of Sciences, Stockholm, Sweden.

* cited by examiner

SYSTEM AND METHOD FOR INTEGRATED PRODUCT PROTECTION

CROSS-REFERENCE TO RELATED PATENT APPLICATIONS

This patent application claims the benefit of U.S. Provisional Patent Application No. 61/430,579, filed Jan. 7, 2011; and U.S. Provisional Patent Application No. 61/453,423, filed Mar. 16, 2011. The entire teachings and disclosures of these provisional applications are incorporated herein by reference thereto.

FIELD OF THE INVENTION

This invention generally relates to systems used for the prevention of theft of packaged products.

BACKGROUND OF THE INVENTION

Theft remains a constant problem with respect to consumer goods both at the retail level and at the distribution level. One example can be found in consumer electronics which have become increasingly more miniaturized and more valuable. As a result, the theft of these items becomes very costly and harder to prevent due to the portability of the items. However, theft of some luxury items, for example, such as clothing, footwear, leather goods and the like can be just as costly, as certain high-end brands for these items may command substantial price tags. Further, these high-value goods may lack robust security features capable of deterring thieves.

It would therefore be desirable to have a system and method that assists retailers and distributors in deterring theft of these consumer goods. Embodiments of the invention provide such a system and method. These and other advantages of the invention, as well as additional inventive features, will be apparent from the description of the invention provided herein.

BRIEF SUMMARY OF THE INVENTION

In one aspect, embodiments of the invention provide a method of preventing the theft of packaged products from a building. The method includes the steps of incorporating an electronic device into the packaging material for the packaged product, and configuring the electronic device to activate an alarm if the packaged product is removed from the building prior to deactivation of the electronic device. In an embodiment, the method further includes configuring the electronic device to impair the function or appearance of the packaged product if the packaged product is removed from the building prior to deactivation of the electronic device.

In a particular embodiment, incorporating an electronic device into the packaging material for the packaged product comprises incorporating a radio frequency (RF) tag into the packaging material for the packaged product. In an alternate embodiment, incorporating an electronic device into the packaging material for the packaged product comprises incorporating an acousto-magnetic tag into the packaging material for the retail.

In a particular embodiment, incorporating an electronic device into the packaging material for the packaged product comprises incorporating a battery-operated electronic device into the packaging material. In an alternate embodiment, incorporating an electronic device into the packaging material for the packaged product comprises incorporating a solar-powered electronic device into the packaging material. In a further embodiment, incorporating an electronic device into the packaging material for the packaged product comprises incorporating an electronic device powered by the energy of wireless signals received by the electronic device.

In a particular embodiment, incorporating an electronic device into the packaging material for the packaged product comprises printing a flexible electronic circuit onto the packaging material. In at least one embodiment, printing a flexible electronic circuit onto the packaging material comprises printing a flexible electronic circuit onto packaging material made from one of cardboard, paper, and cloth. In another embodiment, printing a flexible electronic circuit onto the packaging material comprises printing a flexible electronic circuit onto packaging material made from one of wood, plastic, and metal.

In a particular embodiment, incorporating an electronic device into the packaging material for the packaged product comprises laminating a flexible electronic circuit onto the packaging material. In a more particular embodiment, laminating a flexible electronic circuit onto the packaging material comprises laminating a flexible electronic circuit onto the packaging material made from one of cardboard, paper, and cloth. In yet another embodiment, laminating a flexible electronic circuit onto the packaging material comprises laminating a flexible electronic circuit onto the packaging material made from one of wood, plastic, and metal.

In at least one embodiment, configuring the electronic device to activate an alarm comprises configuring the electronic device to activate an optical alarm or an audible alarm. In a more particular embodiment, configuring the electronic device to activate an alarm comprises configuring the electronic device to simultaneously activate both an optical alarm and an audible alarm.

In a further embodiment, configuring the electronic device to impair the function or appearance of the packaged product comprises configuring the electronic device to activate one of an ink tag, a glue dispenser, polyurethane cartridge, and a fragrance dispenser. In yet a further embodiment, the electronic device delays activation of one of the ink tag, glue dispenser, polyurethane cartridge, and fragrance dispenser for a period of time after removal from the building.

In a particular embodiment, the aforementioned method further comprises configuring the electronic device to activate an alarm if the packaged product is shielded from an external signal prior to deactivation of the electronic device. In a more particular embodiment, configuring the electronic device to activate an alarm if the packaged product is shielded from an external signal comprises configuring the electronic device to activate an alarm if the packaged product is shielded from an external optical signal. In an alternate embodiment, configuring the electronic device to activate an alarm if the packaged product is shielded from an external signal comprises configuring the electronic device to activate an alarm if the packaged product is shielded from an external wireless electrical signal.

In another aspect, embodiments of the invention provide a method of preventing the theft of packaged products from a building. The method includes the steps of incorporating an electronic device into the packaging material for the packaged product, and configuring the electronic device to activate an alarm if the packaged product is shielded from an external signal prior to deactivation of the electronic device. In an embodiment, the method further includes configuring the electronic device to impair the function or appearance of the packaged product if the packaged product is removed from the building prior to deactivation of the electronic device.

In a particular embodiment, incorporating an electronic device into the packaging material for the packaged product comprises incorporating a radio frequency (RF) tag into the packaging material for the packaged product. In a further embodiment, incorporating an electronic device into the packaging material for the packaged product comprises incorporating an acousto-magnetic tag into the packaging material for the retail.

In a particular embodiment, incorporating an electronic device into the packaging material for the packaged product comprises incorporating a battery-operated electronic device into the packaging material. In a further embodiment, incorporating an electronic device into the packaging material for the packaged product comprises incorporating a solar-powered electronic device into the packaging material. In an alternate embodiment, incorporating an electronic device into the packaging material for the packaged product comprises incorporating an electronic device powered by the energy of wireless signals received by the electronic device.

In a particular embodiment, incorporating an electronic device into the packaging material for the packaged product comprises printing a flexible electronic circuit onto the packaging material. In a more particular embodiment, printing a flexible electronic circuit onto the packaging material comprises printing a flexible electronic circuit onto packaging material made from one of cardboard, paper, and cloth. In another particular embodiment, printing a flexible electronic circuit onto the packaging material comprises printing a flexible electronic circuit onto packaging material made from one of wood, plastic, and metal.

In a particular embodiment, the aforementioned method further comprises configuring the electronic device to activate an alarm if the packaged product is removed from the building prior to deactivation of the electronic device. In a more particular embodiment, configuring the electronic device to activate an alarm comprises configuring the electronic device to activate an optical alarm or an audible alarm. In an alternate embodiment, configuring the electronic device to activate an alarm comprises configuring the electronic device to simultaneously activate both an optical alarm and an audible alarm.

In a particular embodiment, configuring the electronic device to impair the function or appearance of the packaged product comprises configuring the electronic device to activate one of an ink tag, a glue dispenser, a powder dispenser, polyurethane cartridge, and a fragrance dispenser. In a more particular embodiment, the electronic device delays activation of one of the ink tag, glue dispenser, powder dispenser, polyurethane cartridge, and fragrance dispenser for a period of time after removal from the building.

In at least one embodiment, configuring the electronic device to activate an alarm if the packaged product is shielded from an external signal comprises configuring the electronic device to activate an alarm if the packaged product is shielded from an external optical signal. In an alternate embodiment, configuring the electronic device to activate an alarm if the packaged product is shielded from an external signal comprises configuring the electronic device to activate an alarm if the packaged product is shielded from an external wireless electrical signal.

In yet another aspect, embodiments of the invention provide an electronic security and benefit denial system for packaged products. In at least one embodiment, the system includes an electronic circuit that, when activated, is configured to activate an alarm in response to presence of an RF signal. Further, in a particular embodiment, the electronic circuit including control circuitry configured to active a benefit denial feature. The electronic circuit is further configured to be incorporated into the packaging for the packaged product. In a particular embodiment, the system includes an antenna coupled to the electronic circuit, wherein the antenna is configured to transmit a signal to activate the alarm.

In a particular embodiment, the electronic security and benefit denial system further comprises a low-voltage battery configured to provide power to the electronic circuit. In an alternate embodiment, the electronic circuit is configured to be powered by solar energy. In yet another embodiment, the electronic circuit is configured to be powered by energy from wireless electrical signals received by the electronic circuit via the antenna. In a further embodiment, the antenna is configured to receive and RF signal, and wherein the absence of the RF signal causes the electronic device to activate the alarm.

In an embodiment, the benefit denial feature includes an ink tag, or a glue dispenser, polyurethane cartridge, or a fragrance dispenser. In a particular embodiment, the electronic security and benefit denial system further comprises an optical sensor coupled to the electronic device, wherein the electronic device is configured to activate the alarm when the optical sensor fails to detect an optical signal.

In a particular embodiment, the electronic device comprises a flexible circuit configured to be printed onto the packaging for the packaged product. In a more particular embodiment, the packaging material is made from one of cloth, paper, and cardboard. In an alternate embodiment, the packaging material is made from one of wood, plastic, and metal. In a further embodiment, the electronic device comprises a flexible circuit configured to be laminated onto the packaging for the packaged product. In yet a further embodiment, the packaging material is made from one of cloth, paper, and cardboard. In yet another embodiment, the packaging material is made from one of wood, plastic, and metal.

In a further embodiment of the invention, the electronic device is made from conductive graphene. In a particular embodiment, the conductive graphene is added to the pulp used to make paper packaging material. The graphene can be a flexible circuit that is printed in a method of either screen print, flexographic, offset or inkjet.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
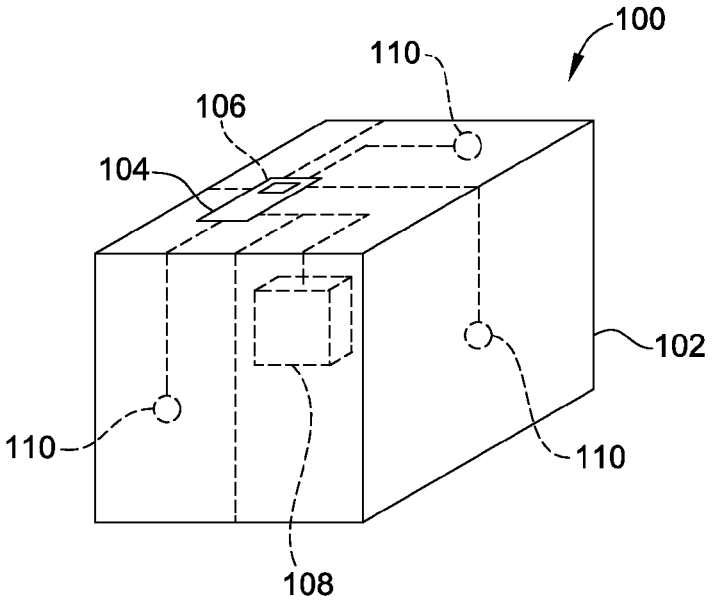
FIG. 1 is a perspective view of an exemplary packaged product incorporating an electronic security system to prevent theft of the item, in accordance with an embodiment of the invention.
Figure 2:
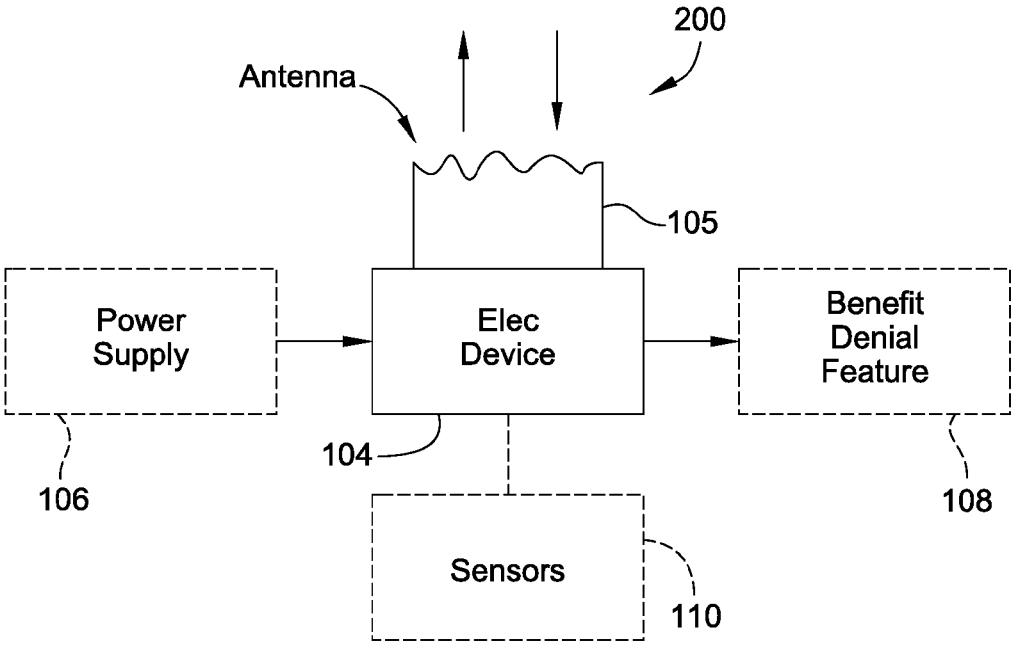
FIG. 2 is a schematic diagram for circuitry configured for use in an electronic security and benefit denial system, in accordance with an embodiment of the invention.

FIGS. 1 and 2 illustrate exemplary embodiments of an electronic security system having an optional benefit denial feature, the system configured to deter and prevent theft, for example, the theft of packaged products or retail items from buildings, such as retail establishments and distribution warehouses. One beneficial feature of the electronic security system and benefit denial feature is that in particular embodiments, the system is configured to be integrated into the packaging for the retail item. However, one of ordinary skill in the art will recognize, that while embodiments of the invention are particularly described with respect to their application in a retail environment, the invention may be employed in other environments as well. It is envisioned that the invention could be utilized in production environments to deter employee theft of certain raw materials, or of manufactured products. Further, embodiments of the invention could also be employed in storage and distribution operations, including, but not limited to, warehouses, shipping terminal, and the like.

FIG. 1 is a perspective view of a product 100, which, in at least one embodiment, is a retail item or packaged product incorporating an embodiment of the invention. Product 100 includes packaging 102 into which has been integrated an electronic security device 104 configured to deter and prevent theft of product 100. In embodiments of the invention, the electronic security device 104 is a thin-film device that can be printed onto the surface of the packaging 102 material, or laminated onto the surface of the packaging 102 material.

Generally, the process for printing electronics permits the use of flexible substrates, which, in some cases, lowers production costs and allows for the manufacture and of mechanically bendable, flexible circuits, which can be incorporated into devices in a variety of shapes and contours. Typically, the term "printed electronics" relates processes in which one or more inks, composed of carbon-based compounds. These other terms refer to the ink material, which can be deposited on a substrate by solution-based method. In some instances, using a printing process to manufacture electronic circuits reduces the number of process steps, which in turn may substantially reduce the cost to manufacture the electronic circuits, and may also reduce the environmental impact when compared to traditional manufacturing techniques and semiconductor processes, for example.

In at least one embodiment, the thin-film electronic security device 104 is manufactured using transparent semiconductor components, so that the electronic device is largely invisible to the naked eye. This may be desirable when, for example, the manufacturer of product 100 does not want to make the presence of the electronic security device 104 obvious to potential thieves, or, for example, when the manufacturer of product 100 does not want the electronic security device 104 to detract from the appearance of the packaging.

In at least one embodiment, laminating the electronic security device 104 onto the surface of the packaging material 102 involves using a combination of heat and pressure to attach the flexible, thin-film circuitry of electronic security device 104 to the packaging 102. With both printed electronics and lamination of the electronic security device 104, there may be some pre-treatment or preparation of packaging material surface where the electronic security device 104 is to be located.

In a further embodiment of the invention, the electronic security device 104 is fabricated by incorporating circuitry made of conductive graphene onto the packaging material. Graphene is carbon arranged in sheets as thin as one atomic layer. Graphene can be made highly conductive by chemical doping, for example, or by exposure to an electric field. Because graphene is only one atom thick, it is largely transparent. Circuit elements and conductive paths can be fabricated from graphene. In a particular embodiment, a graphene layer is incorporated into the pulp used to make paper packaging material. The graphene layer in the pulp may add sufficient conductivity, which can be used to trigger the electronic security device 104. The graphene can be formed into a flexible circuit that is printed using either screen print, flexographic, offset or inkjet printing methods.

The electronic security device 104 is configured such that integration into the packaging 102 is possible for a wide range of packaging materials. In embodiments of the invention, the electronic security device 104 is printed onto, or laminated onto, packaging materials made from rigid or substantially rigid materials such as wood, metal, hard plastic, and cardboard. However, in other embodiments, the electronic security device 104 is printed or laminated onto flexible, lightweight paper, cloth, cellophane, and flexible plastics such as the transparent thin-film plastics used in a variety of packaging applications.

In cases, where the packaging is made from cellophane or transparent thin-film plastic, it may be advantageous to fabricate a transparent electronic security device 104 such that the appearance of the packaging is substantially similar to the appearance of the packaging without the electronic security device 104.

FIG. 2 is a schematic diagram of the electronic security system 200 including the electronic security device 104. In a particular embodiment, electronic security device 104 is coupled to an antenna 105 configured to transmit and receive electronic signals to and from a security system controller (not shown), for example. In at least one embodiment, the signals exchanged between the electronic security device 104 and the security system controller may cause the security system controller to activate some type of alarm to alert system users of a potential theft.

In an alternate embodiment, the absence of signals exchanged between electronic security device 104 and security system controller may result in activation of an alarm. For example, the electronic security device 104 may send a signal, via antenna 105, to activate an alarm indicating that product 100 has been removed, without proper authorization, from the area of storage or display. In another example, the electronic security device 104 may receive a signal, via antenna 105, the receipt of which prompts the electronic security device 104 to generate a signal in response. In a particular embodiment, the electronic security device 104 is powered by energy from the electronic signals received via antenna 105. In such an embodiment, the electronic security device 104 is passive, only operating in response to a signal transmitted to the electronic security device 104. Such a configuration is relatively lightweight and inexpensive since a separate power supply does not have to be integrated into the electronic security device 104.

However, referring again to FIG. 1 and FIG. 2, it can be seen that the electronic security device 104, in particular embodiments, is configured to be powered by a separate power supply 106 (shown in phantom). The power supply is configured to provide the energy to the electronic security device 104 for signal transmission. In at least one embodiment, the power supply 106 is a low-voltage battery. To be successfully integrated into the various types of packaging materials mentioned above, the battery has a low-profile and is lightweight. Typically, such batteries are limited in terms of the density of energy storage. As such, it is simpler and more cost-effective to fabricate such a power supply 106 as a low-voltage battery.

In an alternate embodiment, the power supply 106 is a thin-film solar energy cell. A thin-film solar cell can be fabricated using the same technology used to fabricate the electronic security device 104. Accordingly, the solar cell can be integrated into the electronic security device 104 quickly and inexpensively while adding very little weight to the assembly. In a particular embodiment, the thin-film solar cell is transparent making it compatible with the deployment of a transparent electronic security device 104. Further, the solar cell also offers the advantage that the user does not have to worry about the solar cell power supply 106 running out of power. With sufficient availability of light, the solar cell can power the electronic security device 104 indefinitely.

FIGS. 1 and 2 also show an embodiment of the electronic security system 200 that includes an optional benefit denial feature 108 (shown in phantom). The benefit denial feature 108 is configured to deny a thief use and enjoyment of the product 100 should the thief succeed in removing the product 100 from the premises of the owner. In a particular embodiment, the benefit denial feature includes an ink tag. In those cases where the product 100 includes a portion made from cloth, paper, or the like, or even certain plastics, an ink tag configured to spray or inject ink onto the product 100 could sufficiently impair the function or appearance of the product 100 to make it useless.

In another embodiment of the invention, the benefit denial feature 108 includes an epoxy or glue dispenser, or a polyurethane cartridge. A sufficient amount of glue or polyurethane could render useless not only products including cloth or paper, but mechanical and electrical products could also be made useless if the moving parts, electronic displays, or circuit boards are fouled with an epoxy or glue. In yet another embodiment, the benefit denial feature 108 is a fragrance dispenser. In some circumstances, the product 100 being substantially composed of, for example, leather, cloth, or some other material suitably disposed to absorb an odor-emitting chemical, may be rendered useless if, for example, a foul-smelling chemical is sprayed onto the product 100, and the resulting odor is not easily removed from the product 100. In a further example, the benefit denial feature 108 includes a powder dispenser. In at least one embodiment, the powder dispenser is configured to dispense a powder that is more visible under ultraviolet light.

The benefit denial feature 108 electrically coupled to the electronic security device 104, and is configured to be activated upon receipt of the appropriate signal from the electronic security device 104. While typically the electronic security device 104 is located on an exterior surface of the packaging 102, the benefit denial feature 108 may be disposed in an interior portion of the packaging 102 such that the electrical connection between the two devices may need to go through the packaging 102.

FIGS. 1 and 2 illustrate a particular embodiment of the electronic security system 200 that includes a plurality of sensors 110 (shown in phantom), each electrically coupled to the electronic security device 104. In the embodiment of FIG. 1, the product 100 is package in box-shaped packaging 102 and the sensors 110 are located on each side of the box-shaped packaging 102. However, in alternate embodiments, the packaging 102 may be configured in a variety of shapes, and the number of sensors 110 may vary depending on the size and shape of the packaging. In at least one embodiment, the sensors 110 are thin-film electronics, which can be printed or laminated onto the surface of the packaging material in the same or similar manner as the electronic security device 104. Moreover, in a particular embodiment, the thin-film sensors 100 are transparent so that the sensors 110, like the electronic security device 104, can be integrated into packaging 102 such that it is substantially invisible to the naked eye.

In at least one embodiment, each of the plurality of sensors 110 is an optical sensor. As such, the sensors 110 may be configured to send a signal to the electronic security device 104 to indicate the presence or absence of light shining on at least some portion of the package 102. For example, referring to FIG. 1, a total absence of light on all of the plurality of sensors 110 could indicate that the product 100 has been concealed to facilitate theft of the product 100. In a particular embodiment of the invention, such an indication by the sensors 110 would cause the electronic security device 104 to generate a signal to activate an alarm in the building, for example the retail establishment or storage facility where the product 100 is kept. Additionally, the electronic security device 104 could generate a signal to activate the benefit denial feature 108, if any, used in the product 100. In at least one embodiment, the electronic security device 104 would only activate the benefit denial feature 108 after a suitable delay, after which the optical sensors 110 continue to indicate a total the absence of light for example, to guard against the unintended activations of the benefit denial feature 108.

In an alternate embodiment, each of the plurality of sensors 110 is an RF sensors. In this embodiment, the plurality of sensors 100 are configured to cause the electronic security device to activate an alarm based on either the presence or absence of an RF signal detected by one or more of the sensors 110. In this embodiment, the presence or absence of a particular RF signal is used to indicate theft of the product. Similar to the example above, the presence or absence of the RF signal would cause the electronic security device 104 to generate a signal to activate an alarm in the building, for example the retail establishment or storage facility where the product 100 is kept. In this embodiment, the RF sensors 110 could also cause the electronic security device 104 to generate a signal to activate the benefit denial feature 108, if any, used in the product 100. In a more particular embodiment, upon receipt of the appropriate signal from one or more RF sensors, the electronic security device 104 would only activate the benefit denial feature 108 after a suitable delay, after which the RF sensors 110 continue to indicate a likely theft for example, to guard against the unintended activations of the benefit denial feature 108.

In a further embodiment of the invention, the electronic security system 200 incorporated into the packaging 102 of product 100 includes a plurality of sensors 110 that includes both optical and RF sensors. In a particular embodiment, the combination of optical and RF sensors would function as described in the examples above, thus allowing the electronic security device 104 to provide a signal, for example to the security system controller, warning of a potential theft based on signals from either an optical or RF sensor.

Figure 3:
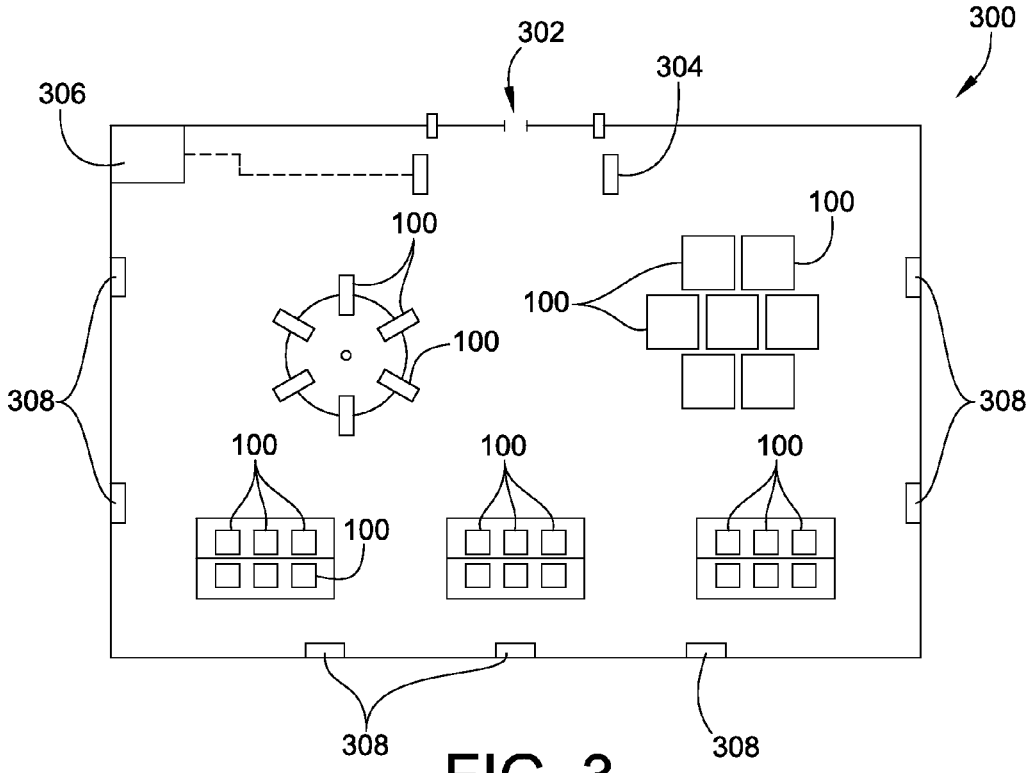
FIG. 3 is a schematic illustration of a typical retail environment in which packaged products include packaging integrated with the electronic security system, in accordance with an embodiment of the invention.

FIG. 3 is a schematic illustration of an exemplary embodiment of a building 300, for example a retail establishment having a security system configured to work with products 100 incorporating an embodiment of the invention. Continuing with the example in which building 300 is a retail establishment, the building 300 includes various shelves and racks 301 to hold a variety of products 100. The building 300 has an entrance 302 through which customers enter and exit the building 300. Positioned proximate the entrance 302 is security detection apparatus 304, which is configured to alert building personnel if a product 100 whose electronic security device 104 has not been deactivated passes through the security detection apparatus 304. In an embodiment, the security detection apparatus 304 is of the type commonly seen in many conventional buildings, the detection apparatus having two components positioned at each side of the entrance 302. In a particular embodiment, the security detection apparatus 304 is connected to a security system controller 306. The connection between the security detection apparatus 304 and security system controller 306 may be hard-wired or wireless.

In the aforementioned embodiment, when a product 100 whose electronic security device 104 has not been deactivated passes through the security detection apparatus 304, the security detection apparatus 304 sends a signal to the security system controller 306, which triggers an alarm 308. The alarm 308 may be optical, audio, or both to alert the building personnel of a potential theft. In this case, the security system controller 306 may also send a command wirelessly to the electronic security device 104 causing it to activate the benefit denial feature 108 (not shown).

In an embodiment of the invention, the building 300 is configured to provide a signal which can be detected by sensors 110 on the products 100. In embodiments where the sensors 110 are optical sensors, a minimum level of lighting is provided such that the optical sensors will cause the electronic security device 104 to generate the appropriate signal if the corresponding product 100 is concealed before it is purchased. In the event that lighting in the building 300 fails, the security system controller 306 is programmed to signal the electronic security device 104 of each product in the affected area to prevent activation of any alarms 308 or benefit denial features 108 (not shown).

In an alternate embodiment, the sensors 110 are electronic sensors configured to detect a signal transmitted wirelessly by the security system controller 306. In such an embodiment, the security system controller 306 is configured to transmit a signal to the sensors 110 periodically. In a particular embodiment, the electronic security device 104 for each product 100 triggers an alarm, activates the benefit denial feature 108, or both if a predetermined time period passes in which no signal is received. In an alternate embodiment, the electronic security device 104 is configured to transmit a signal in response the signal from the security system controller 306. In this case, if the security system controller 306 does not receive the expected number of response signals it will trigger the alarm 308 in the building 300, and may also send a command signal to the non-responding electronic security device 104 to activate the benefit denial feature 108 (not shown).

Figure 4:
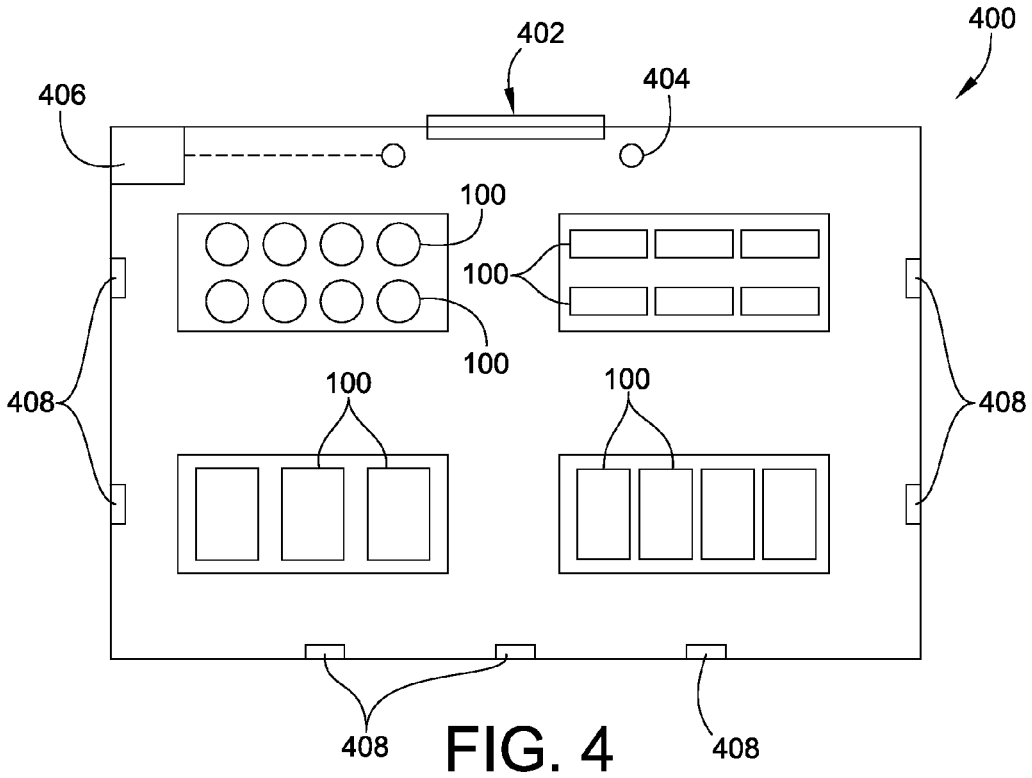
FIG. 4 is a schematic illustration of a typical warehouse and distribution environment in which packaged products include packaging integrated with the electronic security system, in accordance with an embodiment of the invention.

FIG. 4 is a schematic illustration of an exemplary embodiment of a distribution warehouse 400 having a security system configured to work with products 100 incorporating an embodiment of the invention. The distribution warehouse 400 includes various pallet rack and shelves 401 to hold a variety of products 100. The distribution warehouse 400 has an entrance 402 through which employees and visitors can enter and exit the distribution warehouse 400. Positioned proximate the entrance 402 is security detection apparatus 404, which is configured to alert warehouse personnel if a product 100 whose electronic security device 104 has not been cleared passes through the security detection apparatus 404. In an embodiment, the security detection apparatus 404 includes two components positioned at each side of the entrance 402. In a particular embodiment, the security detection apparatus 404 is connected to a security system controller 406. The connection between the security detection apparatus 404 and security system controller 406 may be hard-wired or wireless.

When a product 100 whose electronic security device 104 has not been cleared passes through the security detection apparatus 404, the security detection apparatus 404 sends a signal to the security system controller 406, which triggers an alarm 408. The alarm 408 may be optical, audio, or both to alert the warehouse personnel of a potential theft. In this case, the security system controller 406 may also send a command wirelessly to the electronic security device 104 causing it to activate the benefit denial feature 108 (not shown).

In an embodiment of the invention, the distribution warehouse 400 is configured to provide a signal which can be detected by sensors 110 on the products 100. In embodiments where the sensors 110 are optical sensors, a minimum level of lighting is provided such that the optical sensors will cause the electronic security device 104 to generate the appropriate signal if the corresponding product 100 is concealed before it is cleared to leave the warehouse 400. In the event that lighting in the distribution warehouse 400 fails, the security system controller 406 is programmed to signal the electronic security device 104 of each product in the affected area to prevent activation of the alarms 408 or benefit denial features 108 (not shown).

In an alternate embodiment, the sensors 110 are electronic sensors configured to detect a signal transmitted wirelessly by the security system controller 406. In such an embodiment, the security system controller 406 is configured to transmit a signal to the sensors 110 periodically. In a particular embodiment, the electronic security device 104 for each product 100 triggers an alarm, activates the benefit denial feature 108, or both if a predetermined time period passes in which no signal is received. In an alternate embodiment, the electronic security device 104 is configured to transmit a signal in response the signal from the security system controller 406. In this case, if the security system controller 406 does not receive the expected number of response signals it will trigger the alarm 408 in the distribution warehouse 400, and may also send a command signal to the non-responding electronic security device 104 to activate the benefit denial feature 108 (not shown).

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of preventing the theft of packaged products from a building, comprising the steps of:

incorporating an electronic device into the packaging material for the packaged product;

configuring the electronic device to activate an alarm if the packaged product is removed from the building prior to deactivation of the electronic device;

further configuring the electronic device to impair the function or appearance of the packaged product if the packaged product is removed from the building prior to deactivation of the electronic device.

2. The method of claim 1, wherein incorporating an electronic device into the packaging material for the packaged product comprises incorporating a radio frequency (RF) tag or an acousto-magnetic tag into the packaging material for the packaged product.

3. The method of claim 1, wherein incorporating an electronic device into the packaging material for the packaged product comprises incorporating a battery-operated or solar-powered electronic device into the packaging material.

4. The method of claim 1, wherein incorporating an electronic device into the packaging material for the packaged product comprises incorporating an electronic device powered by the energy of wireless signals received by the electronic device.

5. The method of claim 1, wherein incorporating an electronic device into the packaging material for the packaged product comprises printing or laminating a flexible electronic circuit onto the packaging material.

6. The method of claim 5, wherein printing or laminating a flexible electronic circuit onto the packaging material comprises printing or laminating a flexible electronic circuit onto packaging material made from one of cardboard, cloth, wood, and lightweight paper.

7. The method of claim 5, wherein printing or laminating a flexible electronic circuit onto the packaging material comprises printing or laminating a flexible electronic circuit onto packaging material made from one of plastic, cellophane, and metal.

8. The method of claim 1, wherein incorporating an electronic device into the packaging material for the packaged product comprises incorporating circuitry made from a conductive graphene layer onto the packaging material, wherein the conductive graphene layer is formed into a flexible circuit that is printed onto the packaging material using one of a screen print, flexographic, offset and inkjet printing process.

9. The method of claim 8, further comprising incorporating conductive graphene into pulp used to make paper packaging material.

10. The method of claim 8, wherein incorporating circuitry made from a conductive graphene layer onto the packaging material comprises incorporating circuitry made from a conductive graphene layer onto packaging material made from one of cellophane, cloth, cardboard, plastic, and lightweight paper.

11. The method of claim 1, wherein incorporating an electronic device into the packaging material for the packaged product comprises incorporating a transparent electronic device into the packaging material for the packaged product.

12. The method of claim 1, wherein configuring the electronic device to activate an alarm comprises configuring the electronic device to activate an optical alarm or an audible alarm.

13. The method of claim 1, wherein configuring the electronic device to impair the function or appearance of the packaged product comprises configuring the electronic device to activate one of an ink tag, a glue dispenser, polyurethane cartridge, and a fragrance dispenser.

14. The method of claim 13, wherein the electronic device delays activation of one of the ink tag, glue dispenser, polyurethane cartridge, and fragrance dispenser for a period of time after removal from the building.

15. The method of claim 1, wherein configuring the electronic device to impair the function or appearance of the packaged product comprises configuring the electronic device to activate a powder dispenser having a powder that is more visible when exposed to ultraviolet light.

16. The method of claim 1, further comprising configuring the electronic device to activate an alarm if the packaged product is shielded from an external signal prior to deactivation of the electronic device.

17. The method of claim 16, wherein configuring the electronic device to activate an alarm if the packaged product is shielded from an external signal comprises configuring the electronic device to activate an alarm if the packaged product is shielded from an external wireless electrical signal or an external optical signal.

18. The method of claim 1, further comprising configuring the electronic device to activate an alarm if the packaged product is shielded from an external signal prior to deactivation of the electronic device.

19. An electronic security and benefit denial system for packaged products comprising:

an electronic circuit that, when activated, is configured to activate an alarm in response to presence of a radio frequency (RF) signal, the electronic circuit including control circuitry configured to active a benefit denial feature, the electronic circuit further configured to be incorporated into packaging material for the packaged product;

an antenna coupled to the electronic circuit, the antenna configured to transmit a signal to activate the alarm.

20. The electronic security and benefit denial system of claim 19, further comprising a either a low-voltage battery or a solar power cell to provide power to the electronic circuit.

21. The electronic security and benefit denial system of claim 19, wherein the electronic circuit is configured to be powered by energy from wireless electrical signals received by the electronic circuit via the antenna.

22. The electronic security and benefit denial system of claim 19, wherein the antenna is configured to receive and RF signal, and wherein the absence of the RF signal causes the electronic device to activate the alarm.

23. The electronic security and benefit denial system of claim 19, wherein the benefit denial feature comprises one of a glue dispenser, ink tag and a polyurethane cartridge.

24. The electronic security and benefit denial system of claim 19, wherein the benefit denial feature comprises one of a powder dispenser and a fragrance dispenser.

25. The electronic security and benefit denial system of claim 19, further comprising an optical sensor coupled to the electronic device, wherein the electronic device is configured to activate the alarm when the optical sensor fails to detect an optical signal.

26. The electronic security and benefit denial system of claim 19, wherein the electronic device comprises a flexible circuit either laminated or printed onto the packaging for the packaged product.

27. The electronic security and benefit denial system of claim 26, wherein the packaging material is made from one of wood, cloth, lightweight paper and cardboard.

28. The electronic security and benefit denial system of claim 26, wherein the packaging material is made from one of cellophane, plastic, and metal.

29. The electronic security and benefit denial system of claim 19, wherein the electronic circuit comprises a transparent thin-film material.

30. The electronic security and benefit denial system of claim 19, wherein the electronic circuit is made from conductive graphene.

* * * * *